US006523762B1

(12) United States Patent
Luginbuhl et al.

(10) Patent No.: US 6,523,762 B1
(45) Date of Patent: Feb. 25, 2003

(54) MICROMECHANICALLY PRODUCED NOZZLE FOR PRODUCING REPRODUCIBLE DROPLETS

(75) Inventors: Philippe Luginbuhl, Nods (CH); Pierre François Indermuhle, Hayward, CA (US); Damian Twerenbold, Boudry (CH)

(73) Assignee: GenSpec S.A. (CH)

( * ) Notice: Subject to any disclaimer, the term of this patent is extended or adjusted under 35 U.S.C. 154(b) by 0 days.

(21) Appl. No.: 09/762,891

(22) PCT Filed: Jul. 26, 1999

(86) PCT No.: PCT/CH99/00347

§ 371 (c)(1),
(2), (4) Date: Feb. 8, 2001

(87) PCT Pub. No.: WO00/06388

PCT Pub. Date: Feb. 10, 2000

(30) Foreign Application Priority Data

Jul. 24, 1998 (CH) ..... 1571/98

(51) Int. Cl.[7] ..... A62C 31/02; B05B 1/00; B05B 1/30; B05B 17/00

(52) U.S. Cl. ..... 239/589; 239/596; 239/597; 239/585.3; 239/1

(58) Field of Search ..... 239/589, 596, 239/597, 585.3, 1, 555, 540; 216/2, 27, 56; 205/157, 171; 347/59, 61, 64

(56) References Cited

U.S. PATENT DOCUMENTS 5,560,837 A 10/1996 Trueba
5,781,994 A * 7/1998 Fouillet et al. ..... 29/890.1
5,914,507 A * 6/1999 Polla et al. ..... 257/254
6,143,190 A * 11/2000 Yagi et al. ..... 216/27
6,315,398 B1 * 11/2001 Burke et al. ..... 346/140 R

FOREIGN PATENT DOCUMENTS

| | | |
|---|---|---|
| EP | 58-112755 | 7/1983 |
| EP | 0489246 | 6/1992 |
| EP | 0506128 | 9/1992 |
| WO | 96/32270 | 10/1976 |

OTHER PUBLICATIONS

Moon et al., Methods of Fabricating Microelectromechanical and Microfluidic Devices, Jul. 4, 2002, US 2002/0084242.*

M.M. Farooqui, et al., "Microfabrication of Sub Micron Nozzles in Silicon Nitride", *IEEE Proceedings of the Workshop on Micro Electro Mechanical Systems*, New York, vol. Workshop 5, pp. 150–153.

* cited by examiner

*Primary Examiner*—Michael Mar
*Assistant Examiner*—Davis Hwu
(74) *Attorney, Agent, or Firm*—Ostrolenk, Faber, Gerb & Soffen, LLP

(57) ABSTRACT

The invention relates to a micromechanically produced nozzle for producing reproducibly small drops which consist of a liquid container delimited by a silicon structure and a pyrex structure. The silicon structure is a silicon wafer consisting of a silicon oxide layer ($SiO_2$) and a silicon nitride layer ($SI_3N_4$). The wafer has a nozzle of silicon oxide ($SiO_3$), which forms a nozzle opening of a liquid container. The liquid is fed into the liquid container through a channel formed in the pyrex structure. A disk made of a piezoelectric material exerts a pressure on the liquid in the container, which passes through the nozzle in the form of a drop.

24 Claims, 6 Drawing Sheets

MICROMECHANICALLY PRODUCED NOZZLE FOR PRODUCING REPRODUCIBLE DROPLETS

The invention relates to a micromechanically produced nozzle for producing reproducibly small drops.

In many devices and applications, liquids have to be dispensed in small and controlled quantities. For this purpose dispensing the liquid in droplet form is suitable. To do this, a suitable liquid reservoir is needed, as are a suitable mechanism for transporting the liquid and a suitable mechanism for producing a drop.

SUMMARY OF THE INVENTION

The object of the present invention is to develop a device for producing reproducibly small drops with diameters up to one micrometer.

This object is achieved by a device having a layered silicon structure with a through opening, a silicon oxide layer on the walls of the through opening, a portion of the silicon oxide layer being free-standing and forming a geometrically accurately defined nozzle opening. The decisive advantage of the present invention resides in the use of micromechanical fabrication methods, which permits the production of mechanical structures with submicrometer-accurate precision. In addition, by suitable selection of coating technologies, the surfaces are treated in such a way that the liquids are repelled or attracted by the surface. The present invention permits the production of reproducible, individual drops of diameters up to one micrometer in one exemplary embodiment. In a further exemplary embodiment, the invention permits the production of a mist of a number of small drops of equal size of up to one micrometer diameter. In a further exemplary embodiment, the nozzle opening can be reduced to a diameter of one micrometer by subsequent deposition of silicon oxide on the nozzle structure.

BRIEF DESCRIPTION OF THE DRAWINGS

Details and further advantages of the invention emerge from the following description of exemplary embodiments read in conjunction with the drawings, in which.

In the figures.

DETAILED DESCRIPTION OF THE PREFERRED EMBODIMENTS

Figure 1:
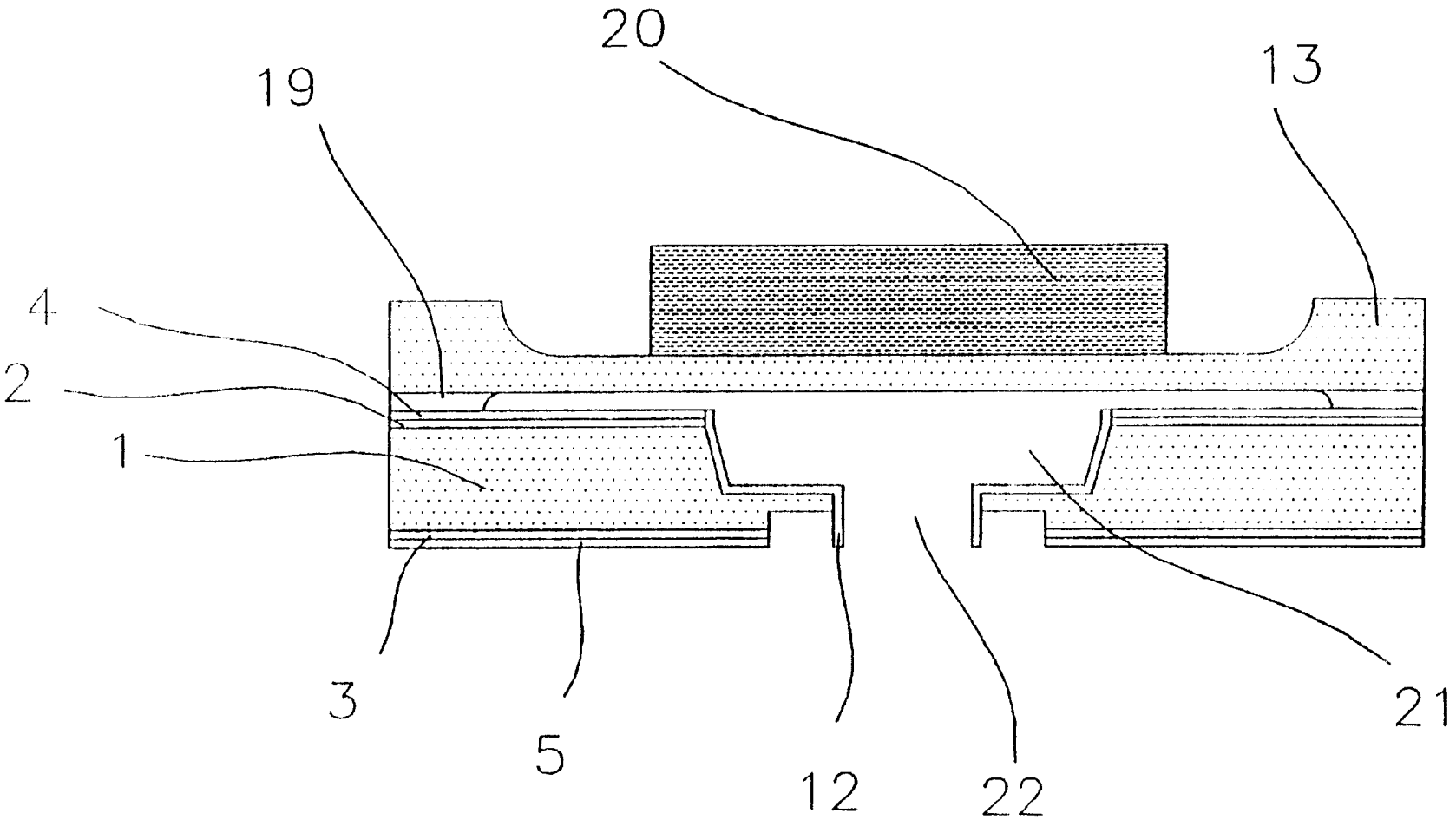
FIG. 1 shows the basic structure of the micromechanically produced nozzle for producing reproducibly small drops.

First of all, the basic structure will be shown by using FIG. 1. The liquid container is delimited by a silicon structure (1) and a pyrex structure (13). The silicon structure is a silicon wafer (1) consisting of a silicon oxide layer ($SiO_2$) (2) and (3), and a silicon nitride layer ($Si_3N_4$) (4) and (5), with a nozzle of silicon oxide ($SiO_2$) (12), which forms a nozzle opening (22) of a liquid container (21). The liquid is led into the liquid container through a channel (19) etched in the pyrex structure. A disk (20) of piezoelectric material produces a pressure on the liquid in (21), said liquid leaving the nozzle (22) in the form of a drop. The free-standing structure of the wall of the nozzle opening (12) prevents the outer surface of the nozzle being wetted and, as a result, the formation of a geometrically accurately defined drop is made possible.

The basic method steps for producing the nozzle opening will be shown using FIG. 2.

Figure 2A:
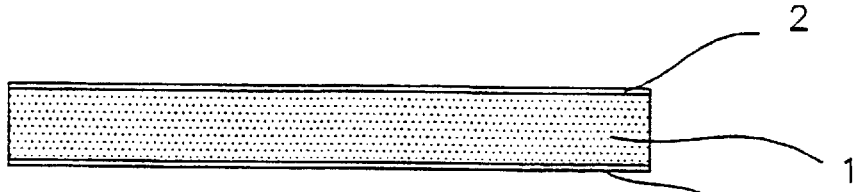
FIG. 2 shows the basic method steps for producing the nozzle opening of the micromechanically produced nozzle for producing reproducibly small drops.

FIG. 2A shows a silicon wafer (1) with a silicon oxide layer ($SiO_2$) (2) and (3), each of about 0.1 $\mu$m layer thickness, grown thermally at about 800° C.

Figure 2B:
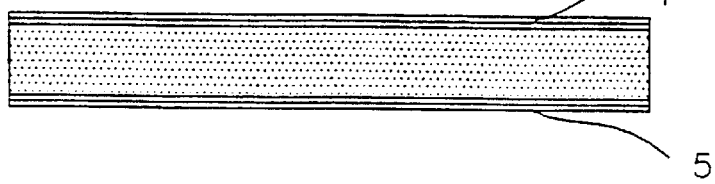

FIG. 2B shows the silicon nitride layer ($Si_3N_4$) (4) and (5), each of about 0.3 $\mu$m layer thickness, applied to both sides by "low pressure chemical vapor deposition" (LPCVD).

Figure 2C:
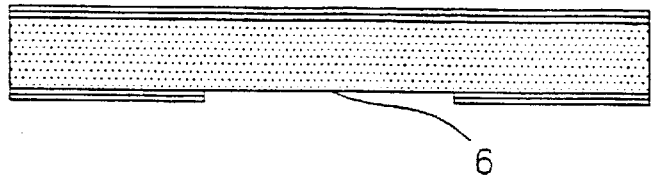

FIG. 2C shows the opening (6) in the silicon nitride layer (5), which is produced by "reactive ion etching" (RIE) with silicon oxide as an etch stop, and the opening (6) in the silicon oxide layer (3), which is produced by "buffered hydrofluoric acid" (BHF) with silicon as an etch stop. In this case, the part which is not to be opened is covered by a photoresist on the layer (5).

Figure 2D:
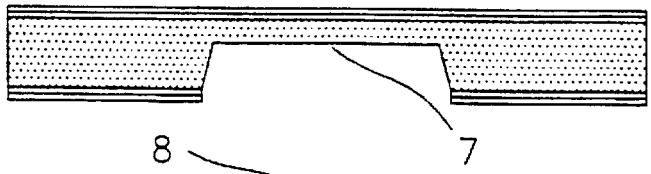

FIG. 2D shows the depression (7) which is produced in silicon by anisotropic etching with potassium hydroxide (KOH). The depth of (7) is determined by the etching time.

Figure 2E:
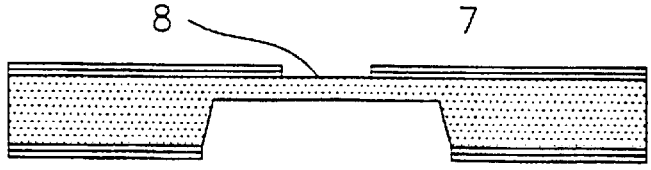

FIG. 2E shows the opening (8) in the silicon nitride layer (4), which is produced by "reactive ion etching" (RIE) with silicon oxide as an etch stop, and the opening (8) in the silicon oxide layer (2) which is produced by "buffered hydrofluoric acid" (BHF) with silicon as an etch stop. In this case, the part of the silicon nitride layer which is not be opened is covered by a photoresist on the layer (4).

Figure 2F:
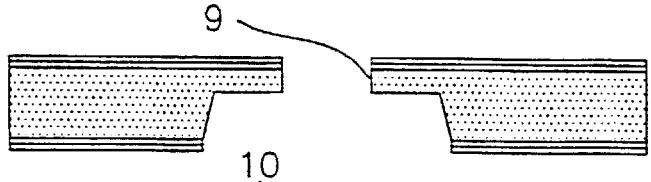

FIG. 2F shows the opening (9), which is produced by the "advanced deep reactive ion etching" (ADRIE) method. This method, by means of suitable selection of the gases and their mixing ratios, permits plasma etching with a very high level of geometric anisotropy of better than 1:30, which in silicon permits depressions of the order of magnitude of 100 $\mu$m with virtually vertical walls. In this case, the part of the silicon which is not to be opened is covered by a photoresist on the layer (4).

Figure 2G:
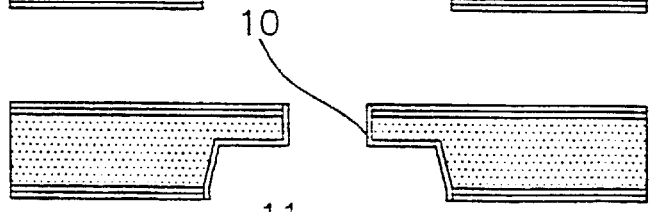

FIG. 2G shows the silicon oxide layer ($SiO_2$) (10) of about 1 $\mu$m layer thickness, which is grown thermally in the depression at about 800° C., and grows on the silicon but not on the silicon nitride.

Figure 2H:
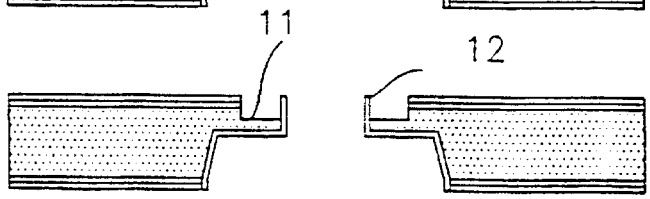

FIG. 2H shows the opening (11) which is produced by "differential reactive ion etching" (DRIE), the silicon being etched to a greater extent than the silicon oxide. In this case, the part of the silicon which is not to be opened is covered by a photoresist on the layer (4).

The basic method steps for producing the pyrex structure will be shown using FIG. 3.

Figure 3A:
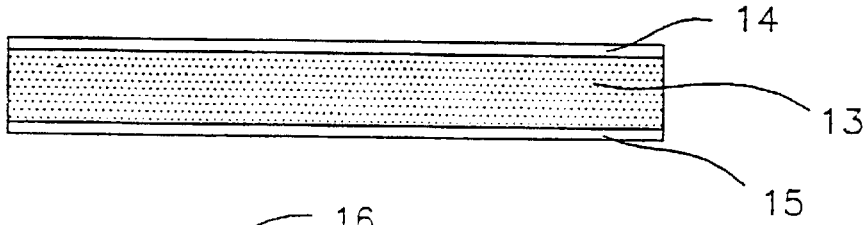
FIG. 3 shows the basic method steps for producing the rear wall of the micromechanically produced nozzle for producing reproducibly small drops.

FIG. 3A shows the polysilicon layer (14) and (15), each of 0.5 $\mu$m layer thickness, applied to both sides of a pyrex disk (13) by "low pressure chemical vapor deposition" (LPCVD).

Figure 3B:
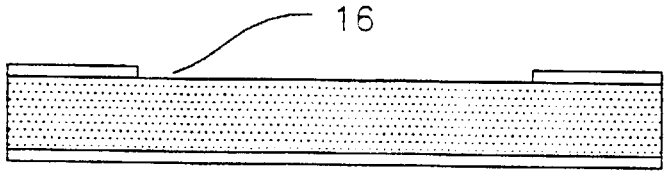

FIG. 3B shows the opening (16) which is introduced into the polysilicon layer (14) and is produced by "reactive ion etching" (RIE), the pyrex acting as an etch stop. In this case, the part of the silicon which is not to be opened is covered by a photoresist on the layer (14).

Figure 3C:
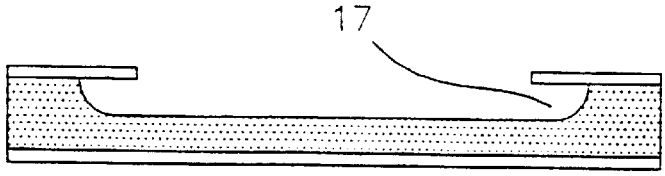

FIG. 3C shows the depression (17) which is introduced into the pyrex disk and is produced by the "hydrofluoric acid" (HF) wet etching method, the etch stop being determined by the etching time.

Figure 3D:
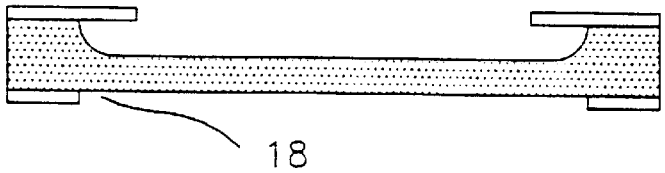

FIG. 3D shows the opening (18) which is introduced into the polysilicon layer (15) and is produced by "reactive ion etching" (RIE), the pyrex acting as an etch stop. In this case, the part of the silicon which is not to be opened is covered by a photoresist on the layer (14).

Figure 3E:
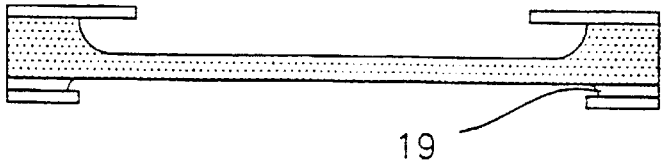

FIG. 3E shows the channels (19) introduced into the pyrex disk, which are produced by the "hydrofluoric acid" (HF) wet etching method, the etch stop being determined by the etching time.

Figure 3F:
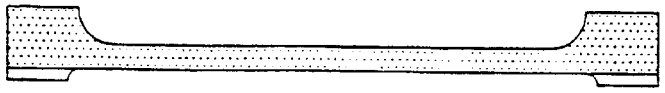

FIG. 3F shows the pyrex structure after the polysilicon layers (14) and (15) have been removed by etching with potassium hydroxide (KOH).

Figure 4:
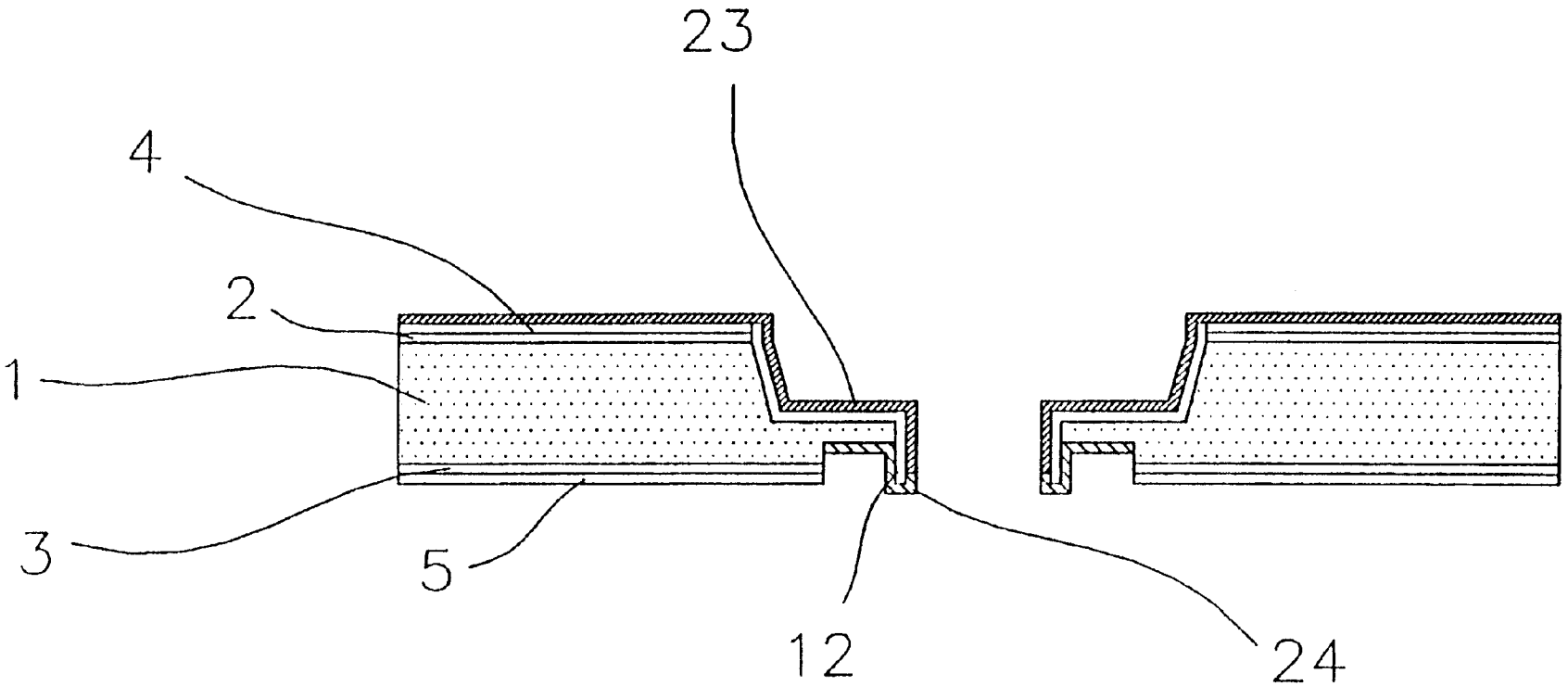
FIG. 4 shows the basic structure of the coatings for controlling the liquid wetting of the micromechanically produced nozzle for producing reproducibly small drops.

FIG. 4 is used to show an exemplary embodiment in which the surface of the silicon structure is coated in order to influence the characteristics of the liquid wetting of the nozzle. The layer (23) is liquid-attracting (hydrophilic in the case of water), and the layer (24) is liquid-repelling (hydrophobic in the case of water). This coating will lead to reproducible drops being formed.

Figure 5A:
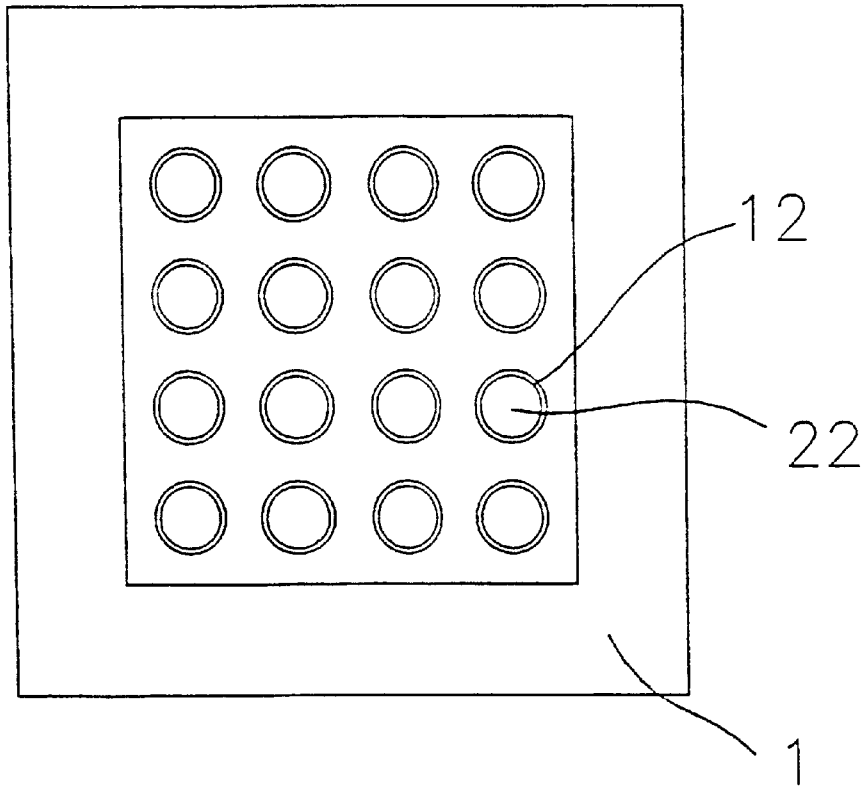
FIG. 5 shows the basic structure of a device having an array of a number of micromechanically produced nozzles with a common liquid reservoir for producing a mist of reproducibly small drops.
Figure 5B:
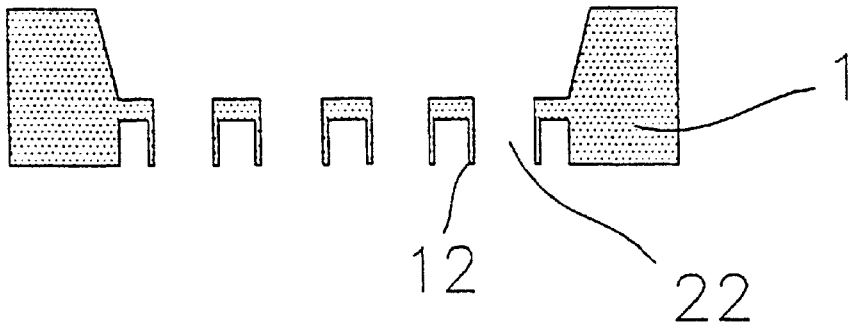

The basic structure of an array of nozzles with a common liquid container for producing a mist of reproducible drops will be shown using FIG. 5. The individual nozzle openings (22) are formed by the silicon oxide structure (12), and are produced in accordance with the method of FIG. 2. The number, size and spacing of the nozzles are determined by the photolithography structure. As a result of the free-standing structure of the wall formed by the silicon oxide structure (12) of the nozzle opening (22), the wetting of the outer surface of the nozzle is prevented, and the drops from the various individual nozzle openings do not join up to form a common large drop. As a result, a mist can be produced from a large number of small, accurately defined drops.

Figure 6:
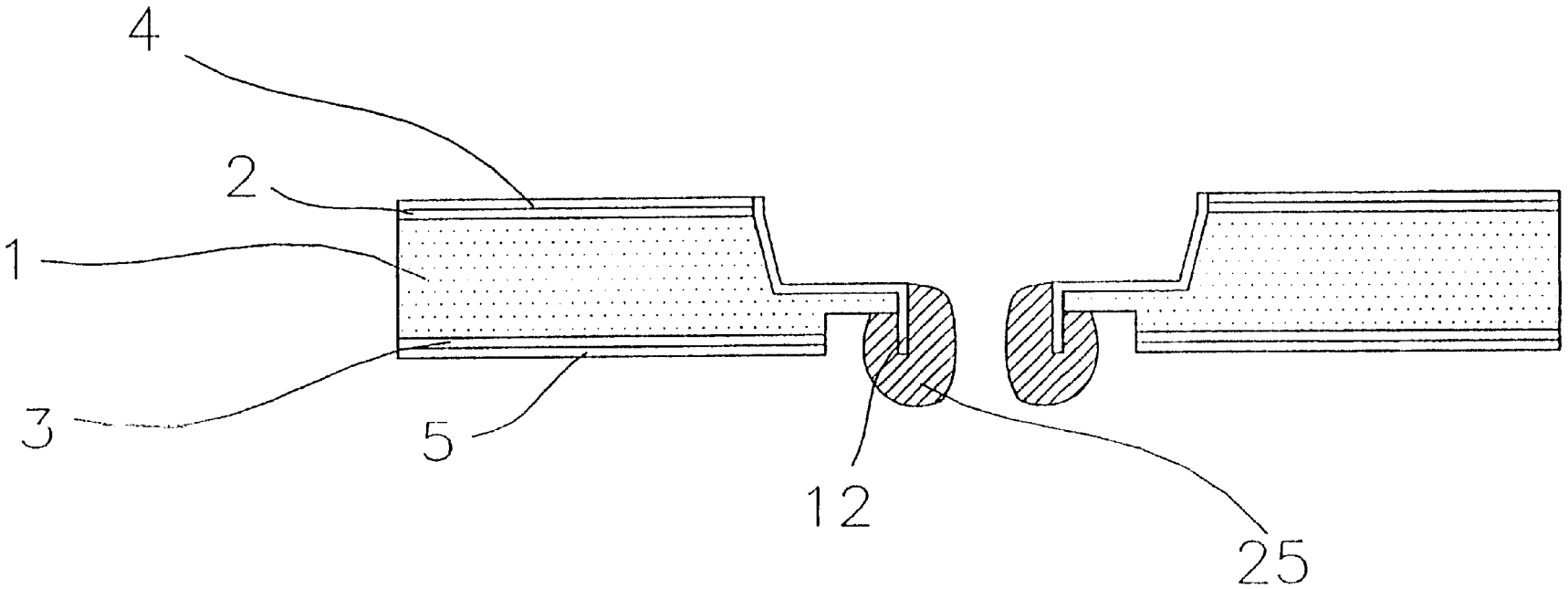
FIG. 6 shows the basic structure of a nozzle opening reduced by silicon oxide coating.

FIG. 6 is used to show an exemplary embodiment in which the diameter of the nozzle opening (22) is reduced to the order of magnitude of a few Am by applying a layer (25) of silicon oxide ($SiO_2$) by the "chemical vapor deposition" (CVD) method.

From what has been mentioned above, it can be seen that the micromechanically produced nozzle for producing reproducibly small drops in this invention has various advantages: it permits the reproducible production of a drop of up to one micrometer diameter. The combination of a number of nozzles coupled with a common liquid reservoir produces a mist of uniform droplets with a diameter up to one micrometer. The invention also permits the controlled production of a liquid surface of a few micrometers diameter.

What is claimed is:

1. A micromechanically produced nozzle for producing reproducibly small drops, comprising:

a silicon substrate having a first surface;

a through opening in the silicon substrate having a wall extending an entire depth of the through opening and through the first surface;

a layer of silicon oxide on the wall of the through opening and freely extending to and beyond the first surface, defining a free extension of the silicon oxide layer extending away from the first surface and beyond the wall of the through opening; and a free-standing nozzle opening being defined inside the through opening wall and the free extension.

2. A nozzle according to claim 1, wherein the through opening is formed by a dry etching process.

3. A nozzle according to claim 1, wherein the layer of silicon oxide is produced by a thermal oxidation process.

4. A nozzle according to claim 1, wherein the free extension is formed by a differential plasma-ion dry etching method.

5. A nozzle according to claim 1, wherein:

the nozzle opening has a diameter at the wall of the through opening in the silicon substrate; and the nozzle further comprises a deposition of at least one of polysilicon oxide and silicon oxide on the interior of the extension thereby reducing the diameter of the nozzle opening.

6. A nozzle according to claim 5, wherein the deposition of the at least one of polysilicon oxide and silicon oxide is produced by chemical vapor deposition.

7. A nozzle according to claim 1, further comprising a layer of liquid repellent on at least one of the first surface of the silicon substrate and the wall of the through opening.

8. A nozzle according to claim 7, wherein the liquid repellent is a synthetic polymer.

9. A nozzle according to claim 7, further comprising a coating of biologically active material on the liquid repellent layer.

10. A nozzle according to claim 1, further comprising a layer of liquid attractant on at least one of the first surface of the silicon substrate and the wall of the through opening.

11. A nozzle according to claim 10, wherein the liquid attractant is a synthetic polymer.

12. A nozzle according to claim 10, further comprising a coating of biologically active material on the liquid attractant layer.

13. A nozzle according to claim 1, further comprising:

a layer of liquid repellent on at least one of the first surface of the silicon substrate and the wall of the through opening; and a layer of liquid attractant on at least the other of the first surface of the silicon substrate and the wall of the through opening.

14. A nozzle according to claim 1, further comprising a liquid reservoir communicating with the through opening.

15. A nozzle according to claim 14, further comprising:

a plurality of the free-standing nozzles spaced from each other to form an array of the free-standing nozzles; and each of the free-standing nozzles communicates with the liquid reservoir.

16. A nozzle according to claim 1, further comprising a plurality of the free-standing nozzles spaced from each other to form an array of the free-standing nozzles.

17. A nozzle according to claim 1, wherein the free extension is further defined by a relieved portion of the silicon substrate surrounding one end of the silicon oxide layer on the wall of the opening.

18. A method of constructing a nozzle for producing reproducibly small drops, comprising:

etching a through opening in a silicon substrate having a first surface, wherein the through opening is etched to have a wall extending an entire depth of the through opening and through the first surface;

forming a layer of silicon oxide on the wall of the through opening, such that the layer of silicon oxide extends to the first surface;

forming a free extension of the silicon oxide layer beyond the wall of the through opening freely extending away from the first surface of the silicon substrate thereby defining a free-standing nozzle opening inside the wall and the free extension.

19. A method according to claim 18, further comprising forming the through opening by a dry etching process.

20. A method according to claim 18, further comprising producing the layer of silicon oxide on the wall of the through opening by a thermal oxidation process.

21. A method according to claim 18, further comprising forming the free extension by a differential plasma-ion dry etching method.

22. A method according to claim 18, wherein:

the silicon substrate has a second surface opposite the first surface and a third surface adjoining and parallel to the first surface; and the method further comprises:

forming a layer of silicon oxide on the second and first surfaces; and forming a layer of silicon nitride on each of the layers of silicon oxide.

23. A method according to claim 18, wherein the free extension is formed by a removal of a portion of the silicon substrate surrounding one end of the silicon oxide layer on the wall of the opening.

24. A nozzle micromechanically produced from a silicon substrate, the nozzle comprising:

a through opening in the silicon substrate having a wall extending an entire depth of the through opening;

a layer of silicon oxide on the wall of the through opening and extending an entire depth of the silicon substrate;

a free extension of the silicon oxide layer on the wall of the through opening freely extending beyond the silicon substrate for forming a free-standing nozzle opening;

a fluid reservoir communicating with the through opening for providing fluid to the nozzle opening; and a piezoelectric element positioned and operable to influence fluid pressure in the fluid reservoir to cause transfer of fluid from the reservoir to the nozzle opening from which the fluid is expelled.

* * * * *